United States Patent [19]

Schenk

[11] Patent Number: 4,958,974

[45] Date of Patent: Sep. 25, 1990

[54] DAMPED BINDING APPARATUS

[75] Inventor: Richard C. Schenk, Webster, N.Y.

[73] Assignee: Xerox Corporation, Stamford, Conn.

[21] Appl. No.: 389,932

[22] Filed: Aug. 7, 1989

[51] Int. Cl.[5] ..... B42C 9/00

[52] U.S. Cl. ..... 412/37; 412/8; 412/9; 412/33; 412/34; 412/900; 412/902; 156/908

[58] Field of Search ..... 412/900, 9, 33, 34, 412/37, 900, 8, 902; 281/21.1; 156/908, 384, 475, 216

[56] References Cited

U.S. PATENT DOCUMENTS

| | | | |
|---|---|---|---|
| 3,608,115 | 9/1971 | Chou et al. | 412/33 |
| 3,804,696 | 4/1974 | Blair | 156/485 |
| 3,953,277 | 4/1976 | Kuhns | 412/11 |
| 3,956,057 | 5/1976 | Jung | 156/578 |
| 4,324,013 | 4/1982 | Wu | 412/33 |
| 4,343,673 | 8/1982 | Smith, Jr. et al. | 156/583 |
| 4,828,645 | 5/1989 | Van Bortel | 56/384 |

*Primary Examiner*—Paul A. Bell
*Assistant Examiner*—Thomas Hamill, Jr.
*Attorney, Agent, or Firm*—H. Fleischer; J. E. Beck; R. Zibelli

[57] ABSTRACT

An apparatus which adhesively binds a set of sheets by applying a strip having an adhesive on one surface thereof to the spine of the set. The strip is supported on a heated platen which softens the adhesive. The spine of the set of copy sheets is pressed into the adhesive on the strip. The depth of penetration of the spine into the adhesive is controlled so as to form a layer of adhesive between the spine and the strip having a predetermined thickness. As the spine of the set of copy sheets is moved into contact with the adhesive on the strip, it is damped to absorb a substantial portion of the kinetic energy of the set of sheets to reduce the deflection and distortion of the set of sheets.

18 Claims, 11 Drawing Sheets

DAMPED BINDING APPARATUS

This invention relates generally to an electrophotographic printing machine, and more particularly concerns an apparatus for adhesively binding sets of finished copy sheets.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a high speed commercial printing systems of the foregoing type, the copy sheets with the information permanently affixed thereto, are transported to a finishing station. After the requisite number of sheets, corresponding to a set of original documents is compiled in the finishing station, the copies of the set are permanently affixed to one another to form a booklet thereof. Most frequently, a stapling apparatus is employed to secure the sheet to one another to form the booklet. However, other alternative techniques have been used such as adhesively binding the sheets to one another. In order for each set of copy sheets to have a bound finished appearance, it is desirable to adhesively secure the sheets of the set to one another. When the printing system produces a large number of copies rapidly, the copy sheets are collected and adhesive is applied to the spine to bind the sheets together into sets of copy sheets. The adhesively bound sets of copy sheets are then stacked for presentation to the machine operator. Numerous methods are known in the art for adhesively securing sheets to one another. For example, a liquid adhesive may be applied to the spine of a moving set of copy sheets, or the copy sheets may be stationary and a container having a supply of adhesive therein may be moved along the spine to apply the adhesive thereon. Alternatively, a tape having an adhesive on one surface thereof may be positioned in contact with the spine and heat applied thereto so as to cause the adhesive to flow between the sheets in the region of the spine securing the sheets together. When binding a set of copy sheets, it is desirable to maintain certain geometries with respect to the adhesive thicknesses in order to form books which will have desirable characteristics. One such desirable characteristic is that the adhesively bound book should be capable of being bent back onto itself so that the covers on opposite sides touch with the region in the vicinity of the spine being flat. In order to insure that the adhesive does not fail along the spine, a finite amount of adhesive is required to be located between the end of each sheet and the tape. Maintaining an adhesive layer of the correct thickness between the end of the set of copy sheets and the tape is a difficult problem in adhesive strip binders where the edge of the set of copy sheets and the adhesive strip are pressed together and heated. When pressure is applied to produce an efficient thermal transfer of heat from the heat source to the adhesive, this pressure will cause the adhesive to flow away from the region between the tape and end of the set of copy sheets. This will result in an inadequate amount of adhesive remaining between the edge of the set of copy sheets and the tape. Hereinbefore, this problem has been solved by adding a gauze of a suitable fiber in the adhesive to prevent the edge of the set of copy sheets from pushing all the adhesive from the region between the tape and the edge of the set of copy sheets. Other approaches control the depth of penetration of the spine into the adhesive. However, it has been found that the dynamic impact energy of the set of sheets being moved into contact with the adhesive results in a reversal in the point of impact by the system. This causes deflection and separation of the sheets of the set as well as premature contact resulting in loss of penetration of the set of sheets into the adhesive. Various approaches have been devised for applying adhesive to the spine of the set of copy sheets. The following disclosures appear to be relevant:

U.S. Pat. No. 3,956,057
Patentee: Jung
Issued: May 11, 1976
U.S. Pat. No. 4,343,673
Patentee: Smith, Jr. et al.
Issued: Aug. 10, 1982
U.S. Pat. No. 4,828,645
Patentee: Van Bortel
Issued May 9, 1989

The relevant portions of the foregoing patents may be summarized as follows:

U.S. Pat. No. 3,956,057 discloses an apparatus for gluing a stack of aligned sheets into a pad or book with a molten adhesive. A lifting assembly including a cam, lever, compression spring, support bracket and solenoid is used to move a clamping device upward or downward around a shaft.

U.S. Pat. No. 4,343,673 describes copy sheets having re-fusable toner along an edge thereof. The copy sheets are bound into booklets by arranging the sheets in a stack and re-fusing the toner so that the re-fused toner causes adjacent sheets to adhere to one another. Pneumatic cylinders with rods are secured between frame members and a plate. The cylinders move a bar toward and away from a heating shoe. Lateral movement of another plate is achieved by another pneumatic cylinder with another rod connected to the other plate. The bar is moved toward the shoe until the sheets therebetween are compressed. The bar and shoe are heated to refuse the toner along the edges of the sheet to bind the sheets to one another.

U.S. Pat. No. 4,828,645 discloses a a binding apparatus which applies a strip having an adhesive onto the spine of a set of sheets. The strip is supported on a heated platen which softens the adhesive. The spine of the set of copy sheets is pressed into the adhesive on the strip. The depth of penetration of the spine into the adhesive is controlled so as to form a layer of adhesive between the spine and the strip having a predetermined thickness.

In accordance with one aspect of the present invention, there is provided an apparatus for binding a set of sheet by applying a strip having an adhesive on one surface thereof to one edge of the set. The apparatus includes means for supporting and heating the strip to soften the adhesive thereon. Means move the supporting means and the set of sheets relative to one another so as to press one edge of the set of sheets into the adhesive on the strip. Means control the depth of penetration of the edge of the set of sheets into the adhesive on the strip so as to form a layer of adhesive between the edge of the set and the strip having a predetermined thickness. Means are provided for damping the moving means to absorb a substantial portion of the kinetic energy of the set of sheets as the set of sheets contacts the adhesive on the strip reducing deflection and distortion of the set of sheets.

Pursuant to another aspect of the features of the present invention, there is provided an electrophotographic printing machine of the type in which successive copy sheets having indicia recorded thereon are compiled into sets and the sheets of each set are bound together by applying a strip having an adhesive on one surface thereof to one edge of the set. The improvement includes means for supporting and heating the strip to soften the adhesive thereon. Means move the supporting means and the set of sheets relative to one another so as to press one edge of the set of sheets into the adhesive on the strip. Means control the depth of penetration of the edge of the set of sheets into the adhesive on the strip so as to form a layer of adhesive between the edge of the set and the strip having a predetermined thickness. Means are provided for damping the moving means to absorb a substantial portion of the kinetic energy of the set of sheets as the set of sheets contacts the adhesive on the strip reducing deflection and distortion of the set of sheets.

Other aspects of the present invention will become apparent as the following description proceeds and upon reference to the drawings, in which.

Figure 4A:
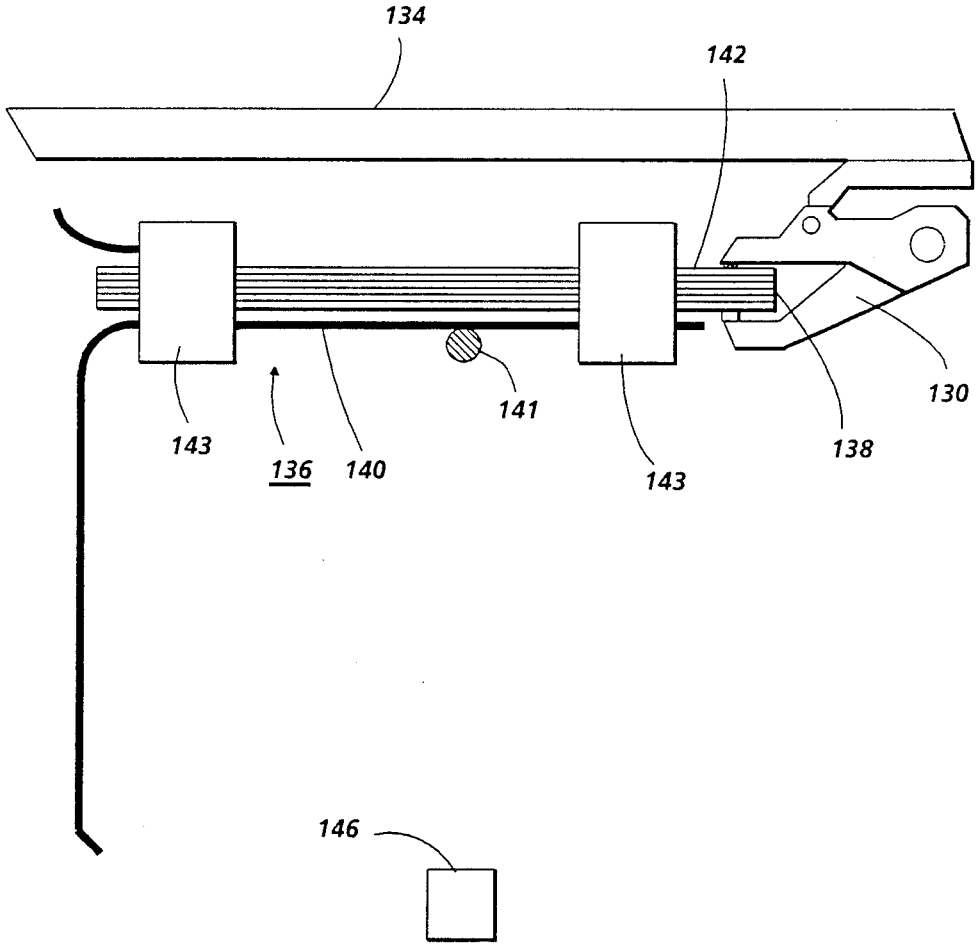
Figure 4B:
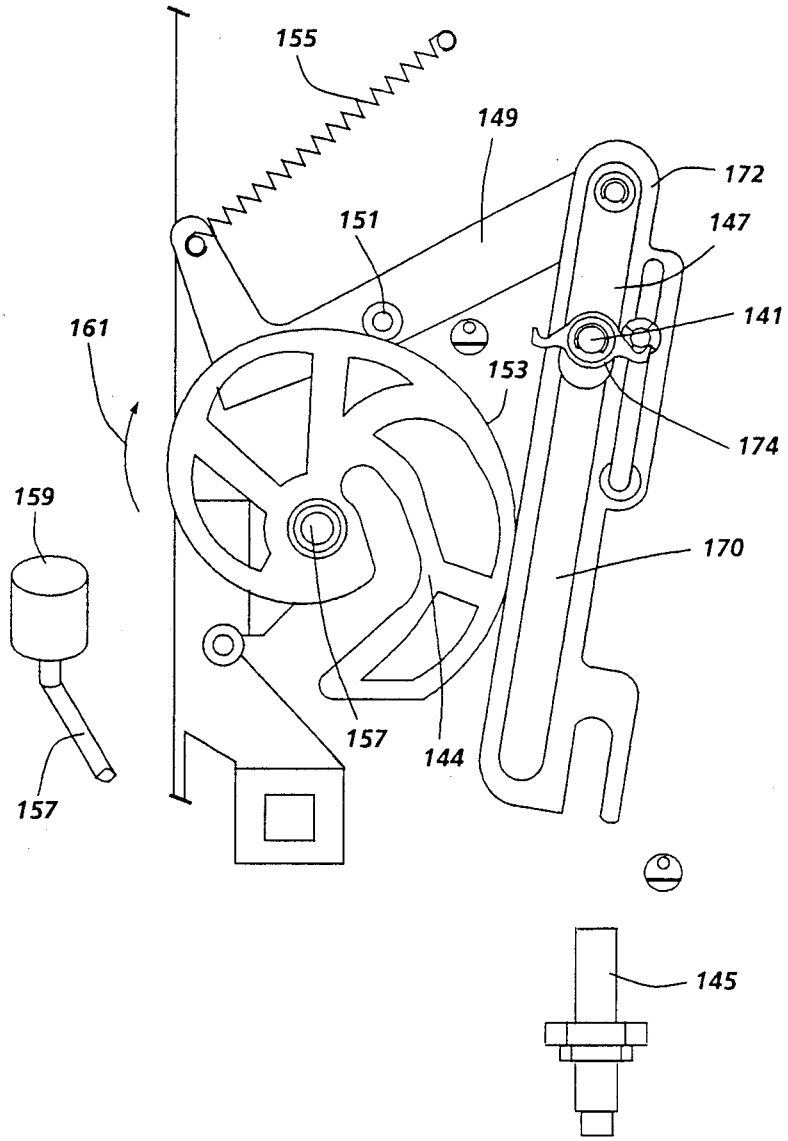
Figure 5A:
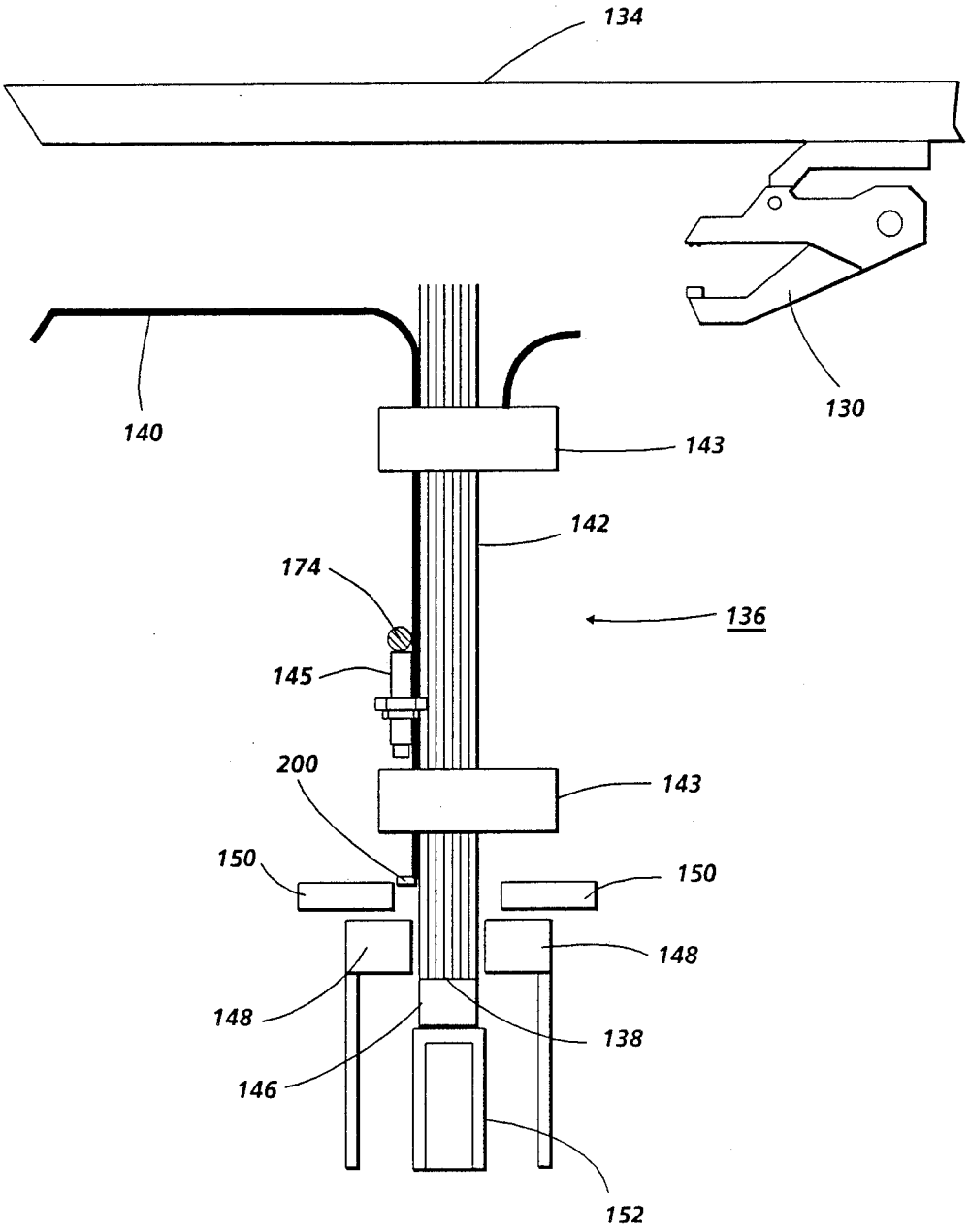
Figure 5B:
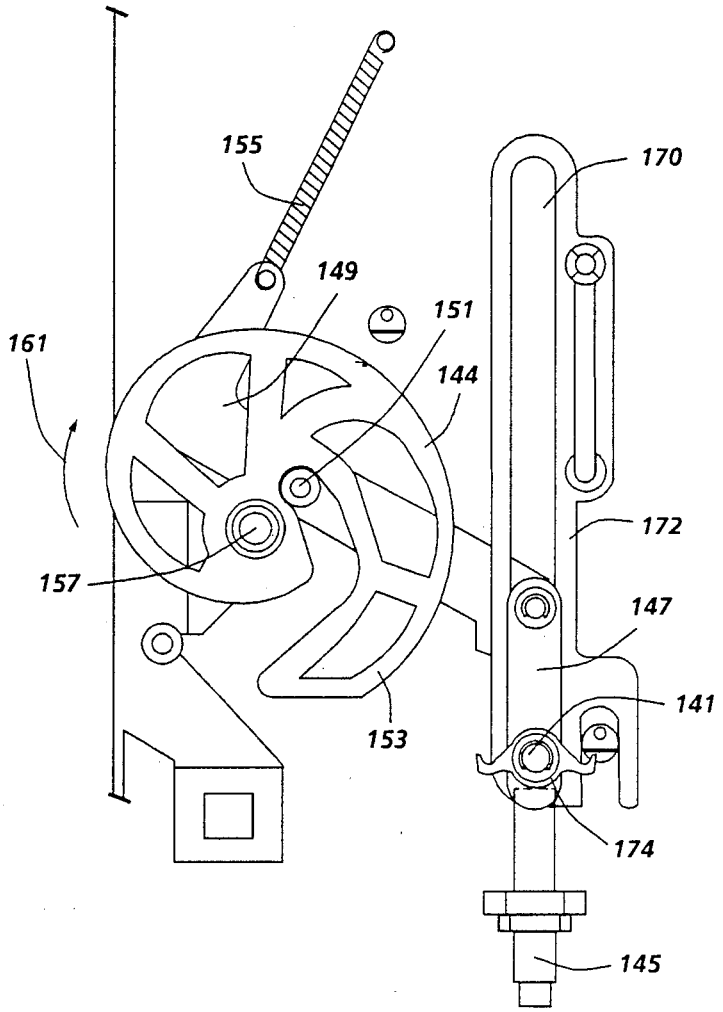
Figure 6A:
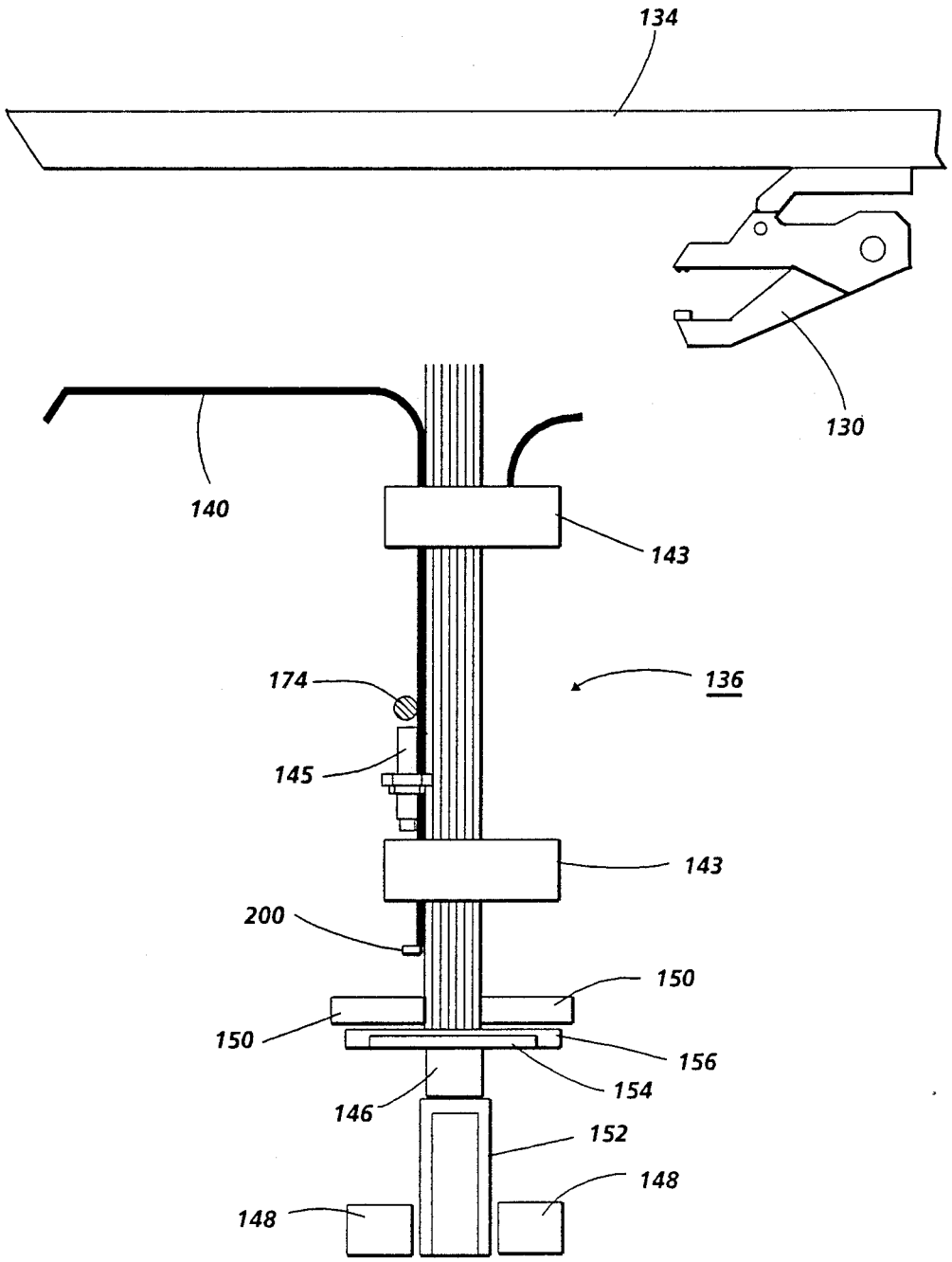
Figure 6B:
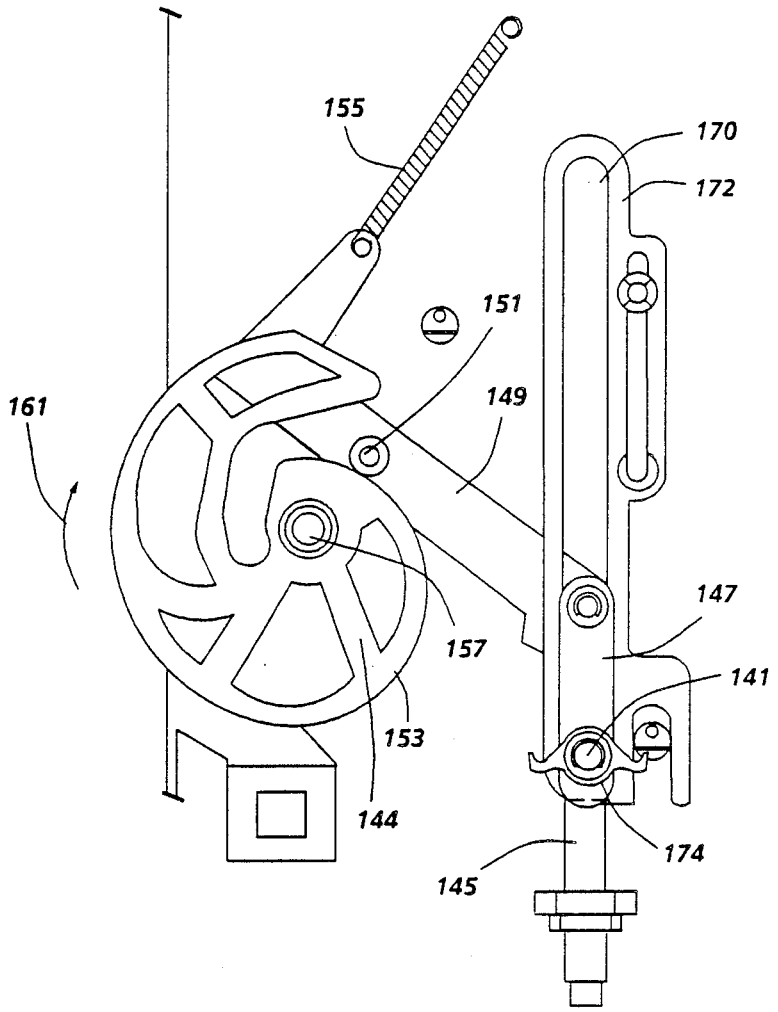
Figure 7A:
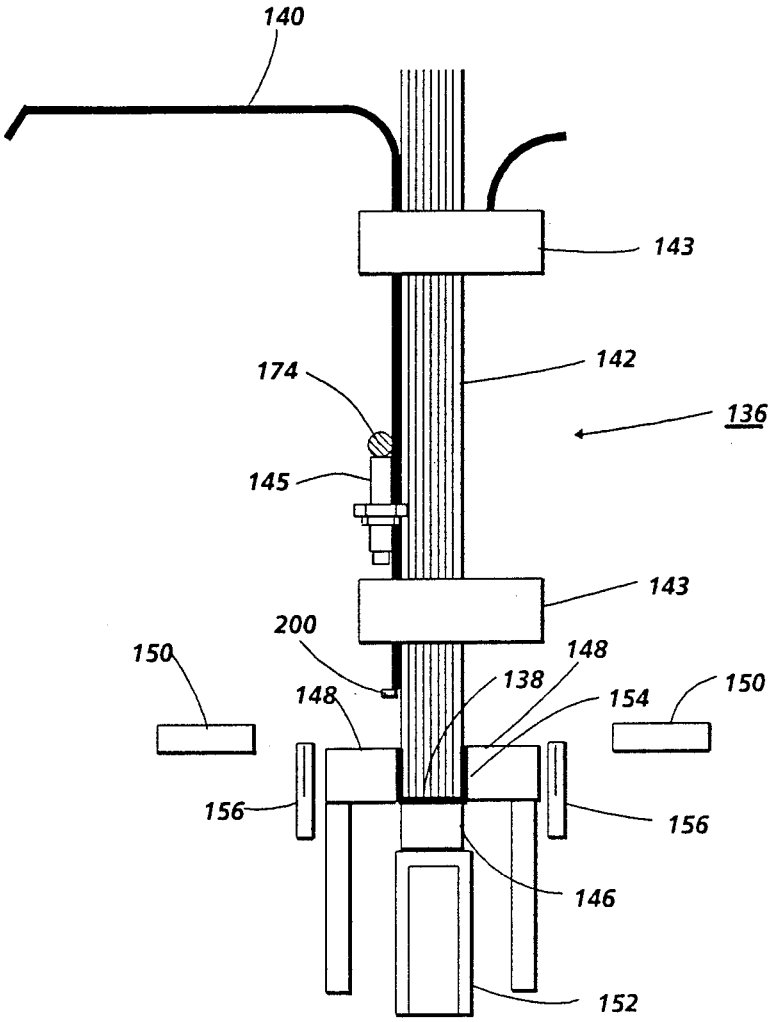
Figure 7B:
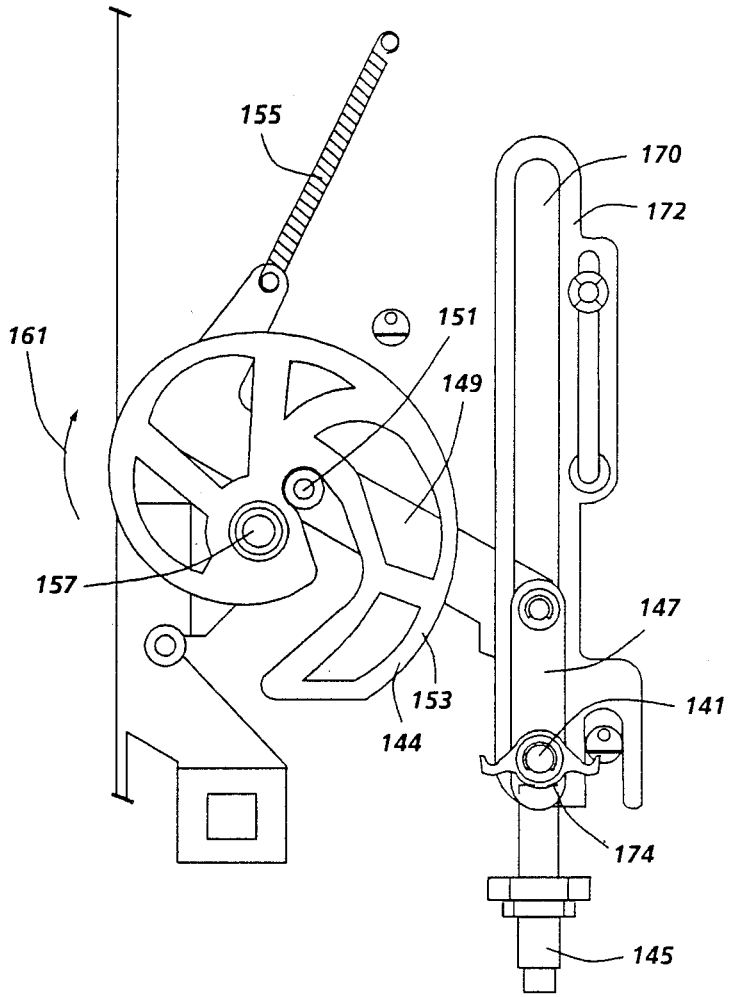

FIG. 4*a* is a schematic elevational view showing a set of copy sheets being received in the binding apparatus;

FIG. 4*b* is a fragmentary perspective view showing the relationship of the cap and shock absorber for the FIG. 4*a* condition;

FIG. 5*a* is a schematic elevational view depicting the set of copy sheet being vibrated in the binding apparatus to register the edges thereof;

FIG. 5*b* is a fragmentary perspective view showing the relationship of the cap and shock absorber for the FIG. 5*a* condition;

FIG. 6*a* is a schematic elevational view illustrating the binding apparatus positioning an adhesive strip on the spine of the set of copy sheets;

FIG. 6*b* is a fragmentary perspective view showing the relationship of the cap and shock absorber for the FIG. 6*a* condition;

FIG. 7*a* is a schematic elevational view showing the binding apparatus bending the sides of the adhesive strip into contact with opposed sides of the outermost sheets of the set of copy sheets; and FIG. 7*b* is a fragmentary perspective view showing the relationship of the cap and shock absorber for the FIG. 7*a* condition.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
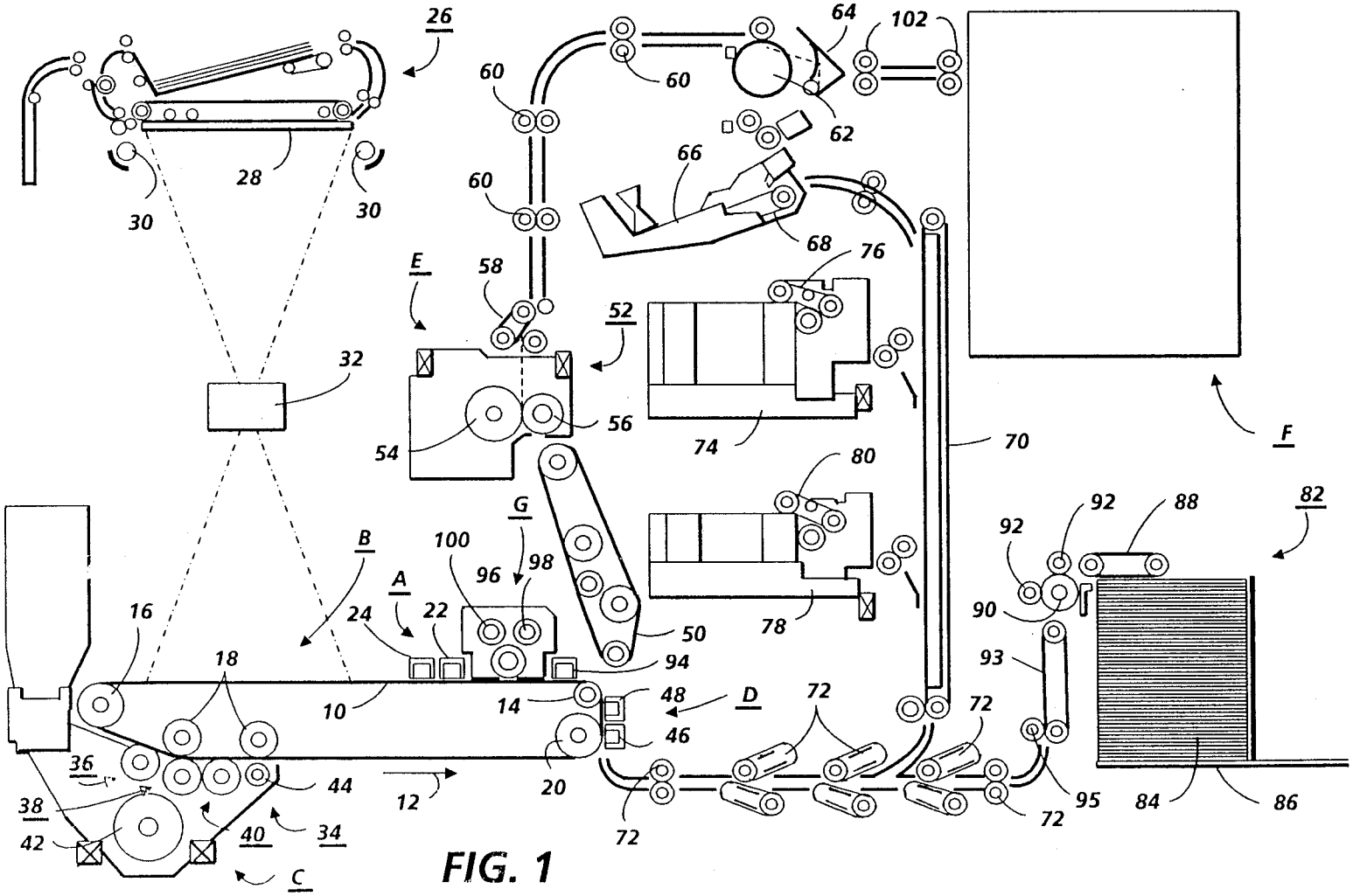
FIG. 1 is a schematic elevational view depicting an illustrative electrophotographic printing machine incorporating the sheet binding apparatus of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the sheet binding apparatus of the present invention may be employed in a wide variety of devices and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on a anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generation layer is made from trigonal selenium. The ground layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means, such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24 charge photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of photoconductive belt 10 is advanced through imaging station B. At imaging station B, a document handling unit, indicated generally by the reference numeral 26, is positioned over platen 28 of the printing machine. Document handling unit 26 sequentially feeds documents from a stack of documents placed by the operator in the document stacking and holding tray. The original documents to be copied are loaded face up in the document tray on top of the document handling unit. A document feeder located below the tray forwards the bottom document in the stack to rollers. The rollers advance the document onto platen 28. When the original document is properly positioned on platen 28, a belt transport is lowered onto the platen with the original document being interposed between the platen and the belt transport. After imaging, the original document is returned to the document tray from platen 28 by either of two paths. If a simplex copy is being made, the original document is returned to the document tray via the simplex path. If this is the inversion pass of a duplex copy, then the original document is returned to the document tray through the duplex path. Imaging of a document is achieved by two Xenon flash lamps 30 mounted in the optics cavity which illuminate the document on platen 28. Light rays reflected from the document are transmitted through lens 32. Lens 32 focuses light images of the original document onto the charged portion of the photoconductive surface of belt 10 to selectively dissipate the charge thereon. This records an electrostatic latent image on photoconductive belt 10 which corresponds to the informational areas contained within the original document. Thereafter, photoconductive belt 10 advances the electrostatic latent image recorded thereon to development station C.

At development station C, a magnetic brush developer unit, indicated generally by the reference numeral 34, has three developer rolls, indicated generally by the reference numerals 36, 38 and 40. A paddle wheel 42 picks up developer material and delivers it to the developer rolls. When developer material reaches rolls 36 and 38, it is magnetically split between the rolls with half of the developer material being delivered to each roll. Photoconductive belt 10 is partially wrapped about rolls 36 and 38 to form extended development zones. Developer roll 40 is a cleanup roll. Magnetic roll 44 is a carrier granule removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pretransfer light from a lamp (not shown) to reduce the attraction between photoconductive belt 10 and the toner powder image. Next, a corona generating device 46 charges the copy sheet to the proper magnitude and polarity so that the copy sheet is tacked to photoconductive belt 10 and the toner powder image attracted from the photoconductive belt to the copy sheet. After transfer, corona generator 48 charges the copy sheet to the opposite polarity to detack the copy sheet from belt 10. Conveyor 50 advances the copy sheet to fusing station E.

Fusing station E includes a fuser assembly, indicated generally by the reference numeral 52 which permanently affixes the transferred toner powder image to the copy sheet. Preferably, fuser assembly 52 includes a heated fuser roller 54 and a pressure roller 56 with the powder image on the copy sheet contacting fuser roller 54. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 58. Decurler 58 bends the copy sheet in one direction to put a known curl in the copy sheet and then bends it in the opposite direction to remove that curl.

Forwarding rollers 60 then advance the sheet to duplex turn roll 62. Duplex solenoid gate 64 guides the sheet to the finishing station F or to duplex tray 66. The details of finishing station F will be described hereinafter with reference to FIG. 2. The duplex tray 66 provides an intermediate or buffer storage for those sheets that have been printed on one side and on which an image will be subsequently printed on the second, opposed side thereof, i.e. the sheets being duplexed. The sheets are stacked in duplex tray 66 face down on top of one another in the order in which they are copied.

In order to complete duplex copying, the simplex sheets in tray 66 are fed, in seriatim, by bottom feeder 68 from tray 66 back to transfer station D via conveyor 70 and rollers 72 for transfer of the toner powder image to the opposed sides of the copy sheets. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 74 The secondary tray 74 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 76. Sheet feeder 76 is a friction retard feeder utilizing a feed belt and take-away rolls to advance successive copy sheets to transport 70 which advances the sheets to rolls 72 and then to transfer station D.

Copy sheets may also be fed to transfer station D. from the auxiliary tray 78. The auxiliary tray 78 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 80. Sheet feeder 80 is a friction retard feeder utilizing a feed belt and take-away rolls to advance successive copy sheets to conveyor 70 which advances the sheets to rolls 72 and then to transfer station D.

Secondary tray 74 and auxiliary tray 78 are secondary sources of copy sheets. A high capacity feeder, indicated generally by the reference numeral 82, is the primary source of copy sheets. High capacity feeder 82 includes a tray 84 supported on an elevator 86. The elevator is driven by a bidirectional motor to move the tray up or down. In the up position, the copy sheets are advanced from the tray to transfer station D. A vacuum feed belt 88 feeds successive uppermost sheets from the stack to a take away drive roll 90 and idler rolls 92. The drive roll and idler rolls guide the sheet onto transport 93. Transport 93 and idler roll 95 advance the sheet to rolls 72 which, in turn, move the sheet to transfer station station D.

Invariably, after the copy sheet is separated from the photoconductive surface of belt 10, some residual particles remain adhering thereto. After transfer, photoconductive belt 10 passes beneath corona generating device 94 which charges the residual toner particles to the proper polarity. Thereafter, a pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 96 and two de-toning rolls 98 and 100, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

Figure 2:
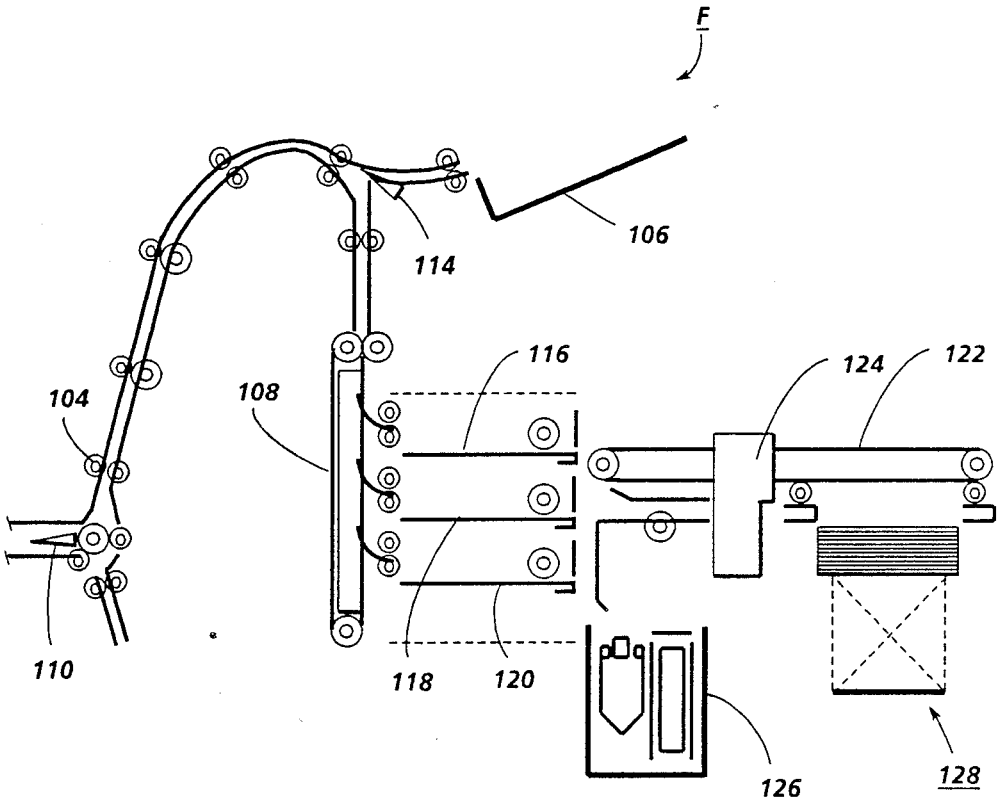
FIG. 2 is a schematic elevational view showing the finishing station of the FIG. 1 printing machine with the sheet binding apparatus.

Referring now to FIG. 2, the general operation of finishing station F will now be described. Finishing station F receives fused copies from rolls 102 (FIG. 1) and delivers them to solenoid actuated gate 110. Gate 110 diverts the copy sheet to either registration rolls 104 or an inverter. A tri-roll nip is used to drive sheets into and out of the inverter. Inverter has a reversible AC motor which drives a roll pair defining a nip that reverses the direction of the sheets and assists in driving them out of the inverter. Inverter is driven by a motor. Two cross roll registration nips are used to register the sheets. The cross roll registration nips are driven by the sheet path drive motor. Rolls 104 advance the copy sheets to gate 114. Gate 114 diverts the sheets to either the top tray 106 or to vertical transport 108. Vertical transport 108 is a vacuum transport which transports sheets to any one of three bins 116, 118 or 120. Bins 116, 118, and 120 are used to compile and register sheets into sets. The bins are driven up or down by a bidirectional AC bin drive motor adapted to position the proper bin at the unloading position. A set transport 122 has a pair of set clamps mounted on an air cylinder and driven by two air valve solenoids. The air valves are used for positioning the set transport and two are used for the retract function. The set transport is used to transport sets from the bins to sheet stapling apparatus 124, binder 126 and sheet stacker 128. The stapled, bound, or unfinished sets are delivered to stacker 128 where they are stacked for delivery to the operator.

Figure 3:
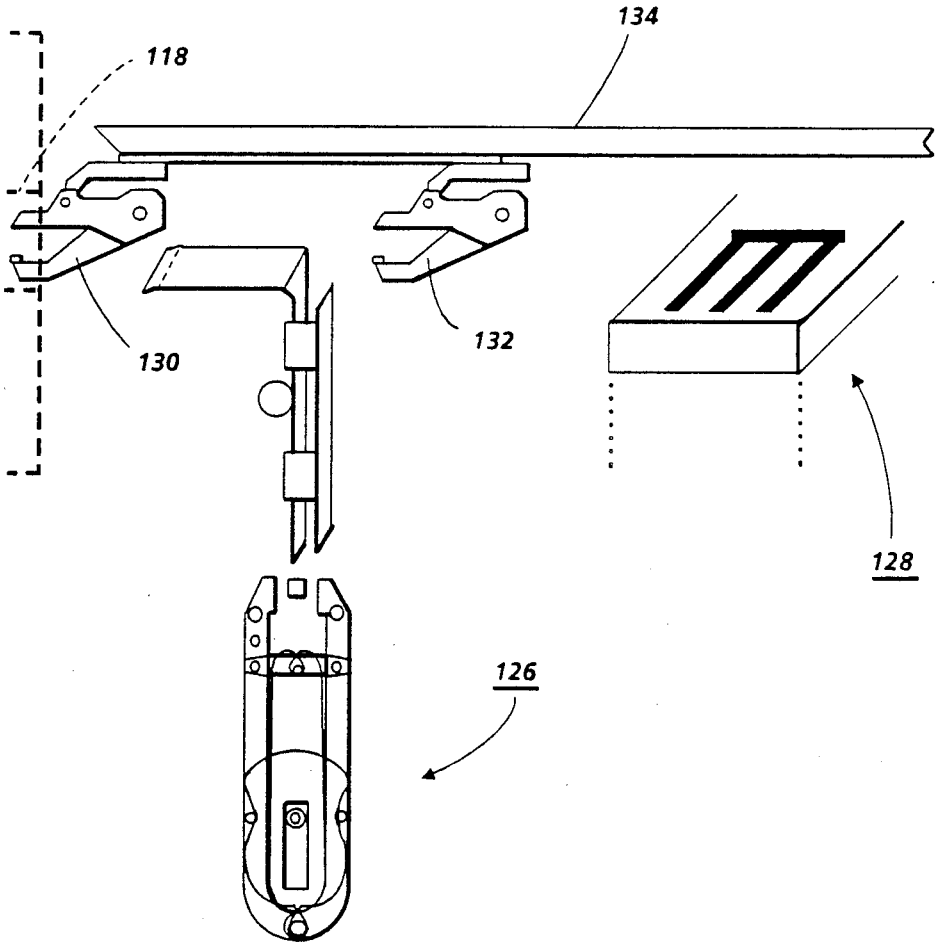
FIG. 3 is a schematic elevational view further illustrating the FIG. 2 finishing station with the binding apparatus.

Turning now to FIG. 3, there is shown the general operation of the sheet binding apparatus in the finishing station. As shown, set clamps 130 and 132 are mounted on a set transport carriage 134 and pneumatically driven by a compressor. Set clamp 130 removes sets from bins 116, 118 and 120. These sets are delivered to binding apparatus 126. Set clamp 132 removes the sets from binding apparatus 126 and delivers them to stacker 128, where they are stacked for delivery to the operator. Set clamps 130 and 132 are mounted fixedly on carriage 134 and move in unison therewith.

As shown in FIG. 4*a*, set clamp 130 advances the set of copy sheets from bin 118 (FIG. 3) to a tilt bed, indicated generally by the reference numeral 136, of binding apparatus 126. Tilt bed 136 receives the set of copy sheets 142 from set clamp 130 and positions the set of copy sheets 142 for the binding operation. Once the binding operation is completed, tilt bed 136 retrieves the bound set of copy sheets 142 and positions them for pick up by the set clamp 132 (FIG. 3). Tilt bed 136 accepts sets of copy sheets 142 from set clamp 130, with the spine 138, i.e. the edge to be bound, leading, and controls the position of the set of copy sheets 142 during the binding operation. Tilt bed 136 includes a guide structure 140 with dual clamps 143 mounted thereon. Clamps 143 are spaced from one another and hold the set of copy sheets on guide structure 140. The clamping action of clamps 143 is pneumatically driven through a solenoid. The required air pressure is provided by the Finisher compressor. In the horizontal position, clamps 143 are in the open position to receive the set of copy sheets 142 from set clamp 130. Clamps 143 clamp the set of copy sheets to the guide structure so as to move in unison therewith. Guide structure 140 is mounted on a shaft 141 which, in turn rides on a pair of spaced cams (FIG. 4*b*) disposed on opposed sides of guide 140. A 120 volt AC bidirectional motor (not shown) rotates a cam drive shaft to rotate the cams. As the cams rotate, shaft 141 follows the contour thereof and guide structure 140 pivots clockwise 90° from the horizontal position to the vertical position for registration, as shown in FIG. 5*a*.

Turning now to FIG. 4*b*, there is shown cam 144 and its relationship with shaft 141 and shock absorber 145. As depicted thereat, shaft 141 is mounted on one end of arm 147 through a slot 170 in link 172. A roller 174 is mounted on the portion of shaft 141 extending outwardly from arm 147. The other end of arm 147 is pivotably connected to one end of arm 149. A cam follower 151, located intermediate opposed ends of arm 149, rides on cam surface 153. The other end of arm 149 is connected to spring 155. The other end of spring 155 is connected fixedly to guide 140. Cam 144 is mounted on cam drive shaft 157. Motor 159 rotates shaft 157 so that cam 144 rotates in the direction of arrow 161. As cam 144 rotates in the direction of arrow 161, shaft 141 moves to move guide 140 from the horizontal position to the vertical position shown in FIG. 5*a*.

Continued rotation of cam 144 moves guide 140 in a vertically downward direction, as shown in FIG. 5*a*. When tilt bed 136 is in the vertical position, the two binder flappers 148, on either side of the binder head 146, move in an upwardly direction to form a U-shaped opening. Tilt bed 136 is moved in a downward direction until roller 174 on shaft 141 contacts the piston of shock absorber 145. Slot 170 in link 172 allows for the continued movement of arm 147 and shaft 141 in a downward direction. The downward movement of shaft 141 is damped by the movement of the piston in a downward direction relative to the cylinder of the shock absorber. This dampens the contact of the spine 138 of the set of sheets 142 with bind head 146. A sensor, preferably a light emitting diode and photodiode, detects the position of cam 144 and de-energizes the motor 159 rotating cam 144. After the guide structure 140 has moved downwardly, the set of copy sheets is positioned in the U-shaped opening with edge 138 thereof abutting bind head 146. At this time, clamps 143 open. Bind head 146 is a platen having a generally planar surface onto which the set of copy sheets is registered and which is internally heated for the binding process. Platen 146, located between flappers 148, serves as a fixed surface for registering the set of copy sheets, and as a source of heat for activating the glue on the adhesive tape when binding the set spine. Teflon is coated on the upper surface of platen 146 to reduce sticking of the tape thereto. Flappers 148 limit set spreading during registration, form the flaps in the adhesive tape during folding of the adhesive tape flaps or sides, and press and heat the tape flaps onto the top and bottom sheets or covers of the set of copy sheets. The flappers are moved by cams driven by a 120 volt AC unidirectional motor connected to a cam shaft. At the start of each cycle, the flappers are moved up for set registration and then the flappers when are moved down registration is completed. Thereafter, the flappers move up and press the sides of the adhesive tape against the outermost sheets of the set for binding. The flappers also pivot the spring loaded tape guides out of the way. Another set of cams changes the path of the flappers when opening from a bound set. Thermistors are used to monitor the operating temperature of the platen and flappers. Calipers 150 are air actuated paper clamps mounted above the flappers. The calipers are used to straighten the set of copy sheets at the completion of registration and during the spine bind cycle. Air pressure presses the calipers against the set of copy sheets while the set is in contact with the adhesive tape during the bind operation and before the flappers are raised for binding the tape to the set sides in order to reduce flaring of sheets near the binding edge. A vibrator, indicated generally by the reference numeral 152, is attached to the underside of platen 146. Vibrator 152 includes an AC power supply which drives a solenoid coupled to platen 146. Vibrator 152 vibrates platen 146 at two frequencies for two levels of vibration force. When the set of copy sheets is initially positioned in contact with platen 146, vibrator 152 vibrates platen 146 at full force, i.e. at 50 volts and 60 hertz. For the remainder of the registration cycle, the set of copy sheets is vibrated at half force, i.e. at 100 volts and 120 hertz. Two levels of force applied in this manner yield better registration than a single level of vibration force. After registration of the copy sheets is completed, clamps 143 of tilt bed 136 close and the tilt bed moves in a vertically upward direction to space edge 138 of set 142 from platen 146 and a tape 154 (FIG. 6*a*) having adhesive on one surface thereof is interposed between platen 146 and spine 138 of set 142. The surface of the tape having the adhesive thereon is positioned to contact the spine of the set of copy sheets.

FIG. 5*b* shows the relationship of cam 144, shaft 141 and shock absorber 145. As depicted thereat, as cam 144 rotates in the direction of arrow 161, cam follower 151 moves on cam surface 153. As cam follower 151 moves on cam surface 153, arms 147 and 149 move in response thereto. As arm 147 moves, shaft 141 moves in unison therewith until roller 174 contact with the piston of shock absorber 145. Further movement of shaft 141 in a downwardly direction causes roller 174 to compress shock absorber 145 so as to dampen the motion of set 142 at the decay rate of shock absorber 145. Shock absorber 145 is a hydraulic shock absorber. It has a stroke of about 10 millimeters. The piston force is about 3 newtons when extended about 9 millimeters and about 7 newtons when compressed about 1.5 millimeters. The energy/cycle is about 0.45 newton-meters/cycle. The hydraulic shock absorber may be obtained from Hughes Industrial Products, 40 North Avenue, Webster, N.Y., as manufacturers part number Endine Inc., SP-8255.

Referring now to FIG. 6*a*, while tilt bed 136 raises the set of copy sheets 142, flappers 148 lower in preparation for receiving the adhesive tape. A tape feeder, driven by a stepper motor, controls the tape size for the bind. The motor advances a length of tape corresponding to the length of the copy sheet edge having the tape applied thereon. The tape is then fed into tape guide 156 and, cut to size, and positioned in tape guide 156. Tape guide 156 is then moved over platen 146 and flappers 148. At this time, calipers 150 press against the sides of the set of copy sheets.

FIG. 6*b* shows the orientation of cam 144 and shaft 141 with respect to shock absorber 145 for position of tilt bed 136 depicted in FIG. 6*a*. As shown thereat, rotation of cam 144 in the direction of arrow 161 has positioned cam follower 151 in a location on cam surface 153 to move arms 147 and 149 such that tilt bed 136 is positioned in the orientation depicted in FIG. 6*a*. In this position, roller 174 is in contact with shock absorber 145 to dampen the forces applied on the set of sheets 142.

Turning now to FIG. 7*a*, platen 146 and flappers 148 are heated to soften the adhesive. After the tape is positioned over the platen and flappers, the lower end of guide structure 140 moves downwardly to engage stop 200 and edge 138 of set 142 is pressed into the softened adhesive on tape 154 a distance sufficient to form a layer of adhesive having a thickness of about 0.254 millimeters between edge 138 and the surface of tape 154 opposed therefrom. Simultaneously therewith, shaft 141 compresses the piston thereof. A sensor, preferably a light emitting diode and a photodiode, detect when cam 144 is in the bind position and de-energizes the motor rotating cam 144. Thus, tilt bed 136 moves in a downwardly direction pressing spine 138 into the softened adhesive on tape 154. Simultaneously, roller 174 on shaft 141 contacts shock absorber 145 and the mass of tilt bed 136 and set 142 compresses shock absorber 145 to dampen the forces applied on the end of the set 142. The bind dwell time is determined by the thickness of set 142 and the combination of bind dwell time and the damping rate of shock absorber 145 resulting in an adhesive layer being formed between spine 138 and the surface of tape 154 having a thickness of about 0.254 millimeters. Calipers 150 are disengaged from the set of copy sheets and flapper 148 moves in a vertically upward direction to bend tape 154 so that the adhesive side thereof presses against opposed outermost sheets of the set of copy sheets. Preferably, flappers 148 and platen 146 are heated to about 265° F. and 425° F., respectively, to thermally activate and soften the adhesive on tape 154. In this way, the adhesive tape is fixed to the spine of the set of copy sheets with a layer of adhesive being formed between the spine and surface of the tape opposed therefrom having a predetermined thickness of about 0.254 millimeters. After the adhesive tape is applied on the spine of the set of copy sheets, the flappers are retracted and the cam 144 is rotated to move the tilt bed in a vertically upward direction to space the bound set of copy sheets from platen 146. As cam 144 continues to rotate, tilt bed 136 then rotates 90° in a counter clockwise direction to position the set of copy sheets in a substantially horizontal orientation. Set clamp 132 then receives the bound edge of the set of copy sheets and transports the set of copy sheets to stacker 128 for subsequent removal from the finishing station by the machine operator.

FIG. *7b* depicts cam follower 151 at its furthermost position on cam surface 153 during the rotation of cam 144 in the direction of arrow 161. In this position arm 147 and arm 149 move shaft 141 to position tilt bed 136 in the position shown in FIG. *7a*. In this position, shaft 141 has compressed the piston of the hydraulic shock absorber 145. Compression of hydraulic shock absorber 145 dampens the forces applied on the set of sheets as the spine contacts the adhesive on the binding tape. This dampens the kinetic energy of the supports of the tilt bed eliminating the reversal of contact loading between the registration and bind cycles. This eliminates mechanical deflection of the tilt bed clamping system. The low contact velocity of the dampened system enables the system to develop a contact pressure between the bound surface of the book and tape as there is little kinetic energy at the moment of contact between the spine of the set and the adhesive to deflect and distort the set.

Further details of the binding apparatus, exclusive of the hydraulic shock absorber, may be found in U.S. Pat. No. 4,828,645 issued to Van Bortel on May 9, 1989, the relevant portions thereof being hereby incorporated into this application.

In recapitulation, the tilt bed of the binding apparatus receives the set of copy sheets and pivots the set of copy sheets from a horizontal plane to a vertical plane. Side flappers move upwardly to define a U-shaped space. The tilt bed moves the set of copy sheets downwardly into the U-shaped space until the tilt bed engages a mechanical stop and the spine edge of the set contacts the binder platen. As the tilt bed moves downwardly, a shock absorber dampens the forces. The binder platen is then vibrated to register the sheets of the copy set with one another. The flappers are than retracted, and the tilt bed spaces the spine edge of the registered sheets of the set from the binder platen. Adhesive tape is interposed between the binder platen and the spine of the set of copy sheets. The tilt bed moves the set of copy sheets downwardly until the end thereof contacts the stop. Simultaneously, the shock absorber dampens the forces. The damping provided by the shock absorber always absorbs the kinetic energy of the tilt bed so as to eliminate the reversal of contact loading between the registration and bind cycles. When the end of the tilt bed contacts the stop, the spine of the set of copy sheets is pressed into the heated, softened adhesive forming a layer of adhesive between the spine and the surface of the tape opposed therefrom having a predetermined thickness. The flappers move upwardly to bend the tape so that the heated, softened adhesive contacts the outermost sheets of the set. Thereafter, the tilt bed returns the set of copy sheets to the horizontal position where the set clamp receives the bound set of copy sheets and moves it to the stacker for removal by the machine operator.

It is, therefore, evident that there has been provided, in accordance with the present invention, a damped sheet binding apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. An apparatus for binding a set of sheets by applying a strip having an adhesive on one surface thereof to one edge of the set, including:

means for supporting and heating the strip to soften the adhesive thereon;

means for moving said supporting means and the set of sheets relative to one another so as to press one edge of the set of sheets into the adhesive on the strip;

means for controlling the depth of penetration of said one edge of the set of sheets into the adhesive on the strip so as to form a layer of adhesive between said one edge of the set and the strip having a predetermined thickness; and means for damping said moving means to absorb a substantial portion of the kinetic energy of the set of sheets as the set of sheets contacts the adhesive on the strip reducing deflection and distortion of the set of sheets.

2. An apparatus according to claim 1, wherein said supporting means is stationary.

3. An apparatus according to claim 2, wherein said damping means includes a shock absorber.

4. An apparatus according to claim 3, wherein said supporting means includes a heated platen defining a generally planar, substantially horizontal support surface.

5. An apparatus according to claim 4, wherein said moving means includes a tilt bed which is adapted to pivot so as to orient the set of sheets substantially vertically and to move the set of sheets in a downward direction toward said supporting means.

6. An apparatus according to claim 5, wherein said controlling means includes means for limiting the movement of said moving means to regulate the depth of penetration of said one edge of the set of sheets into the adhesive on the strip.

7. An apparatus according to claim 6, further including a pair of heated side guides arranged to be normally spaced from the set of sheets and being movable to fold the sides of the strip into contact with opposed outer sheets of the set of sheets and heat the sides of the strip to fix the sides of the strip to the opposed outer sheets of the set of sheets.

8. An apparatus according to claim 6, wherein said limiting means includes at least one stop for limiting the movement of said moving means.

9. An apparatus according to claim 8, wherein said stop limits the penetration of said one edge of the set of sheets into the adhesive of the strip so that the layer of adhesive between said one edge of the set and the strip has a thickness of about 0.254 millimeters.

10. An electrophotographic printing machine of the type having a binding apparatus, and in which successive copy sheets having indicia recorded thereon are compiled into sets and advanced to the binding apparatus which binds the sheets of each set together by applying a strip having adhesive on one surface thereof to one edge of the set, wherein the improved binding apparatus includes:

means for supporting and heating the strip to soften the adhesive thereon;

means for moving said supporting means and the set of copy sheets relative to one another so as to press one edge of the set of copy sheets into the adhesive on the strip;

means for controlling the depth of penetration of said one edge of the set of copy sheets into the adhesive on the strip so as to form a layer of adhesive between said one edge of the set and the strip having a predetermined thickness; and means for damping said moving means to absorb a substantial portion of the kinetic energy of the set of sheets as the set of sheets contacts the adhesive on the strip reducing deflection and distortion of the set of sheets.

11. A printing machine according to claim 10, wherein said supporting means is stationary.

12. A printing machine according to claim 11, wherein said damping means includes a shock absorber.

13. A printing machine according to claim 12, wherein said supporting means includes a heated platen defining a generally planar, substantially horizontal support surface.

14. A printing machine according to claim 13, wherein said moving means includes a tilt bed which is adapted to pivot so as to orient the set of sheets substantially vertically.and to move the set of sheets in a downward direction toward said supporting means.

15. A printing machine according to claim 14, wherein said controlling means includes means for limiting the movement of said moving means to regulate the depth of penetration of said one edge of the set of copy sheets into the adhesive on the strip.

16. A printing machine according to claim 15, further including a pair of heated side guides arranged to be normally spaced from the set of copy sheets and being movable to fold the sides of the strip into contact with opposed outer sheets of the set of copy sheets and heat the sides of the strip to fix the sides of the strip to the opposed outer sheets of the set of copy sheets.

17. A printing machine according to claim 15, wherein said limiting means includes at least one stop for limiting the movement of said moving means.

18. A printing machine according to claim 15, wherein said stop limits the penetration of said one edge of the set of sheets into the adhesive of the strip so that the layer of adhesive between said one edge of the set and the strip has a thickness of about 0.254 millimeters.

* * * * *